US012024952B2

(12) United States Patent
Zhang

(10) Patent No.: US 12,024,952 B2
(45) Date of Patent: Jul. 2, 2024

(54) FORE AND AFT ASSEMBLY OF BELT-TYPE PUMPING UNIT

(71) Applicant: Derui Petroleum Equipment (Qingdao) Co., Ltd., Qingdao (CN)

(72) Inventor: Cong Zhang, Qingdao (CN)

(73) Assignee: Deurui Petroleum Equipment (Qingdao) Co., Ltd., Qingdao (CN)

( * ) Notice: Subject to any disclaimer, the term of this patent is extended or adjusted under 35 U.S.C. 154(b) by 0 days.

(21) Appl. No.: 17/730,001

(22) Filed: Apr. 26, 2022

(65) Prior Publication Data

US 2022/0341266 A1 Oct. 27, 2022

(51) Int. Cl.
*E21B 15/00* (2006.01)

(52) U.S. Cl.
CPC ..... *E21B 15/003* (2013.01)

(58) Field of Classification Search
CPC ..... E21B 15/00; E21B 15/003
See application file for complete search history.

(56) References Cited

U.S. PATENT DOCUMENTS 3,640,342 A * 2/1972 Gault ..... F04B 53/144 277/330
5,018,350 A * 5/1991 Bender ..... F04B 47/04 60/369
5,492,436 A * 2/1996 Suksumake ..... E02B 17/00 301/5.23
2009/0047153 A1* 2/2009 Best ..... E21B 43/126 417/415
2016/0160581 A1* 6/2016 Mao ..... B66F 17/00 187/254
2016/0245276 A1* 8/2016 Robison ..... E21B 43/127
2016/0348448 A1* 12/2016 Miller, Jr. ..... E21B 19/084
2019/0233006 A1* 8/2019 Nguyen ..... B60K 7/0007
2019/0242195 A1* 8/2019 Ghamdi ..... F16H 19/04

* cited by examiner

*Primary Examiner* — Taras P Bemko

(74) *Attorney, Agent, or Firm* — Kenneth H. Jack; Davis & Jack L.L.C.

(57) ABSTRACT

A belt pumping unit moving assembly incorporating a lower fixed base. The assembly further incorporates a rack gear fixedly attached to the lower fixed base. The assembly further incorporates an upper base overlying the lower fixed base wherein the belt pumping unit is fixedly attached to the upper base. The assembly further incorporates a motor and pinion gear combination wherein the motor is mounted upon the upper frame and the pinion gear is engageable with the rack gear. The assembly further incorporates a plurality of wheels or rollers mounted upon the upper base wherein, upon engagement of the pinion gear with the rack gear and upon actuation of the motor, the upper base and the belt pumping unit rollably move along the lower base.

13 Claims, 15 Drawing Sheets

FORE AND AFT ASSEMBLY OF BELT-TYPE PUMPING UNIT

The Applicant herein claims the benefit of International Patent Application No. PCT/CN2021/091256, entitled "For and Aft Assembly of Belt-Type Pumping Unit" filed in the CNIPA PCT world filing office on Apr. 30, 2021. The Applicant further claims the benefit of China National Application No. 202110453326.X having the same title, and filed in the CNIPA on Apr. 26, 2021. Said '326.X CNIPA application constitutes the priority filing claimed in said '256 international PCT application. The Applicant of the instant application and that of said '326.X and '256 applications are one and the same entity, and the inventor of the instant application is named as an inventor in each of said '326.X and '256 applications.

FIELD OF THE INVENTION

The instant invention relates to the field of belt pumping units, in particular to a moving device or base assembly for moving a belt pumping unit.

BACKGROUND OF THE INVENTION

Common types of oilfield pumping rigs or units include walking beam pumping units and tower pumping units. The tower type of pumping unit commonly incorporates a flexible belt spanning over an upper roller within the tower, such belt mechanically linking reciprocating vertical movements of a counterweight within the tower and an oil well's sucker rod or polished rod. Such belt adapted tower pumping units advantageously provide characteristics of long stroke, high efficiency, stability, and reliability. Such units have been widely used in major oil fields.

Due to design characteristics of a belt adapted tower pumping unit's frame, it is often necessary to move the pumping rig backward or away from the wellhead it serves before performing oil well maintenance or repairs, such rig movement commonly being needed to provide working space. It is often necessary to return the rig to its original position upon completion of repairs.

A common method of moving such pumping rigs uses a tractor vehicle to drag the machine along the ground away from the wellhead. However, such method of moving the belt adapted tower pumping unit is time consuming and laborious, and lacks needed stability. Dragging the machine is inconvenient, and a dragging or pushing return of the machine to its original position is often more difficult.

In view of the above problems and challenges, China Patent Publication No. CN204185171U discloses a belt pumping unit moving assembly which moves the belt pumping unit machine backward through operation of a hand hoist, guide wheel and cable assembly. In use of such machinery, workers undesirably are required to continuously pull the hoist, causing inconvenient operation, high labor intensity, and unstable operation.

China Patent Publication No. CN210948603U discloses another belt pumping unit moving assembly which incorporates a hydraulic jack, a rolling pumping unit tower base, a hydraulic pump, a roller support, a steel structure foundation frame, a high pressure hose, a hydraulic push rod, a hydraulic push ring, an ear shaft base, a hydraulic cylinder and base, and base structures where the bases are arranged on an upper surface of the steel structure foundation frame. In such '603 reference, a tower base component of the pumping unit is connected to a separate base component by bolts. Also in such '603 reference, the lower part of the tower base of the pumping unit is equipped with a hydraulic jack, the bottom of the hydraulic jack being fixed upon the steel structure foundation frame by bolts, the middle and rear side of the base being welded with the pin shaft seat, and the pin shaft seat being connected to the bottom of the hydraulic cylinder through the pin shaft. A hydraulic push rod component of the assembly of the '603 reference is connected through the ear shaft base, the lower left part of the hydraulic push rod is equipped with a roller support, the left side of the hydraulic push rod comprises a hydraulic pump, the hydraulic pump is fixed upon the front side of the base by bolts, and the hydraulic cylinder and the hydraulic pump of the reference are interconnected by a high pressure hydraulic hose. Also in the '603 reference, a hydraulic push ring is arranged on the hydraulic push rod. Accordingly, the equipment moving mechanism of the '603 reference may be understood as using hydraulic jack, moving wheel, hydraulic pump, roller support, hydraulic push rod, hydraulic push ring, and hydraulic cylinder components to achieve the backward movement of the whole machine or entire pumping rig. Use of the device of the '603 reference gives rise to the following problems:

1. The design of the '603 reference hydraulic system is complex and the cost is high;
2. Operation of the device of the '603 reference is inconvenient and the movement produced by its mechanism is not stable, resulting in a high failure rate; and
3. Due to the relatively short stroke of the hydraulic cylinder of the '603 reference, multiple disconnections and repositionings of the hydraulic cylinder are required in order to move the machine a significant distance.

BRIEF SUMMARY OF THE INVENTION

Objectives of the instant invention include the provision of a device or base assembly for moving a belt adapted tower pumping unit or belt pumping unit, such device or assembly solving or ameliorating the above referenced prior art belt pumping unit moving problems.

In order to solve the technical problems presented in the prior art, the instant invention provides a belt pumping unit moving device or assembly which comprises a longitudinally extending rack gear attached to and supported by a lower frame or lower base. Such lower frame or lower base suitably comprises a steel structure foundation frame. An upper frame or base is provided, such upper base being capable of being either tightly attached to or held a slight distance vertically away from the steel structure frame. The belt pumping unit is mounted upon the upper frame.

At least four notches which constitute or function as wheel wells are formed at the lateral sides of the upper frame, and wheel assemblies are mounted within such notches or wheel wells. Such wheel assemblies may be configured as wheel receiving clevis brackets which are selectively vertically positionable at rolling engaged positions and disengaged positions.

The rack gear of the assembly is arranged and mounted upon the underlying steel structure foundation frame, such gear being located directly below the upper base. The assembly's upper base or frame is equipped with a motor power device or unit which operatively turns a pinion gear which meshes with the rack gear to drive the upper base horizontally along the steel structure foundation frame.

In a preferred scheme of implementation of the instant invention, the motor power unit comprises an ear plate suitably configured as a clevis hinge, a pivoting frame or arm which is suitably "C" channel configured. A motor driven pinion gear is mounted by an axle upon a distal end of the pivoting frame. Arms of the "C" channel configured pivot frame serve as gear support plates. A proximal end of the pivot frame residing at proximal ends of the two gear support plates is connected to the ear plate or clevis hinge by a hinge pin. A pair of crossbeams span laterally across the upper frame, and the clevis hinge is mounted upon one of the crossbeams. The vertical position of the distal end of the instant invention's pivot frame may be adjusted to cause the pinion gear to alternatively mesh with and disengage from the rack gear.

Also in a preferred implementation scheme, a screw actuator is mounted upon a distal end of the pivot mount for alternatively upwardly pivoting the pivot frame and pinion gear out of engagement with the rack gear and downwardly pivoting such components into engagement with the rack gear.

Also, in the preferred implementation scheme, when the pinion gear meshes with the rack gear, the body of the rack gear is operatively positioned and secured between the two guide plates.

Also, in the preferred implementation scheme, the rack gear is attached to the lower frame by an underlying base, a rail support base, a gear main body, such components being connected sequentially from bottom to top. A travel gap is formed between an end of the gear base and an end of the gear main body, and the bottom of the gear fixing plate is equipped with a pivot limiting assembly. When the pinion gear meshes with the rack gear, a contact element of the pivot limiting assembly pivots downwardly to the lower limit of the gap. The pivot limit assembly may comprise a screw actuator for horizontally extending and retracting the contact element between a pivot stopping position and a clearance position which facilitates unlimited upward pivoting.

Also in the preferred implementation scheme, the clevis bracket supported wheels or rollers are vertically moveably mounted upon the upper frame and within notches or wheel wells formed at the sides of the upper frame. Such bracket and wheel combinations are adapted to alternatively travel to a downwardly extended position in relation to the upper frame and an upwardly disengaged position. While the brackets and wheels are downwardly extended, the wheels bear against the lower frame, slightly raising the upper frame for rolling motion along the lower frame. Upon upward retraction, the bracket and wheel combinations disengage and allow the upper frame to directly rest upon the lower frame.

Also in the preferred implementation scheme, shim plates which suitably comprise durable elastomeric cushions are provided for holding the clevis bracket and wheel combinations in their rolling and engaged positions.

Also in the preferred implementation scheme, laterally outer edges of the shim plates may extend laterally from the wheel wells, such plates presenting convenient handles which facilitate insertions and removals. In an alternate embodiment, the wheel assemblies are equipped with vertical actuators which operatively raise and lower the clevis bracket and wheel combinations. Biasing springs may be provided for holding the clevis and wheel combinations downwardly against the lower frame while the wheels are operatively disengaged.

Also in the preferred implementation scheme, the upper end of the steel structure foundation frame lower base component is equipped with longitudinally extending guide tracks which receive and guide the wheels' rolling motion.

In accordance with working principles of the inventive belt pumping unit moving assembly, the belt pumping unit supporting upper base and the steel structure foundation frame lower base may initially be rigidly connected by bolts. In such configuration, the upper base's wheels or rollers contact the lower base but do not bear the weight of the upper base.

When the belt pumping unit needs to be moved, the sucker rod load of the belt pumping unit may be removed and the balance weight may be lowered to the bottom of the tower to lower the center of gravity. Thereafter, the belt pumping unit and upper base may be released from the steel structure foundation frame by loosening and removing fastening bolts. Thereafter, with the help of lifting equipment such as hydraulic jack, the belt pumping unit and the rolling upper frame or base is slightly lifted. During the lifting process, workers may vertically adjust the position of the clevis bracket and wheel assemblies so that such assemblies may roll along the underlying steel structure foundation frame. Following such adjustment, the downward extensions of the wheel assemblies may be fixed. At the same time, the workers may pivotally adjust the position of the motor power unit so that such assembly's pinion gear meshes with the rack gear. Thereafter, the lifting mechanism may be removed, the weight of the upper rolling frame and the belt pumping unit being transferred to the rollers and to the steel structure foundation frame. Such weight transfer preferably ensures that the weight of the pumping unit uniformly distributed upon the rollers. Providing such uniformity of weight distribution helps reduce excess friction and wear of individual rollers.

Thereafter, the motor component of the power unit may be actuated, causing the pinion gear to rotate, thereby driving the upper rolling base along the underlying steel structure foundation frame. Such motor actuation advantageously achieves horizontal movements of the belt pumping unit away from a wellhead.

After oil well repairs or maintenance have been performed, the belt pumping unit may be oppositely driven by the motor power unit to return to the original position. Thereafter, the belt pumping unit may be lifted again through the use of the lifting equipment. Thereafter, the motor power unit may be upwardly pivoted to its disengaged position, and the upper rolling frame and the lower steel structure foundation frame may be resecured in rigid contact by the bolts. With the belt pumping unit and upper frame rigidly locked upon the steel structure foundation frame, pumping operations may resume.

Compared with the above described prior art, the instant invention has the following beneficial effects:

1) The motor power assembly which drives the belt pumping unit along a rack gear is mechanically simple and has a low cost.
2) The use of the instant invention's motor power unit and rack gear combination produces excellent smooth operation and extremely low mechanical failure rates.
3) Horizontal motion provided by the motor power unit of the instant invention is not limited by any mechanical stroke. The instant inventive assembly is capable of continuously horizontally moving the pumping unit the full length of the rack gear, and without any step-by-step operation.

4) The China Patent Publication No. CN210948603U discloses required steps of transferring the weight of the machine through operation of lifting rollers mounted upon a roller track component of a steel structure foundation frame. Thus, it can be seen that in the device of the '603 reference, such rollers must be installed every time the pumping unit must be moved. While the pumping unit of the '603 reference is operating, such moving rollers and associated components are separate and must be separately stored, subjecting the equipment to misplacement or loss. The process of installation of the moving rollers of the '603 reference degrades efficiencies in moving the belt pumping unit. Also, in use of the mechanism of the '603 reference, the position of the rollers must be repeatedly calibrated in order to prevent derailments in the process of moving. In contrast, in the instant invention, the upper rollable half of the base is always installed over an immobile lower frame, thereby avoiding steps of installing and reinstalling a moving wheel assembly, the instant invention eliminating any need for separate storage of a moving wheel assembly. While the instant inventive assembly is not in use, its vertically moveable clevis bracket and wheel combinations are contained in wheel well notches, advantageously avoiding interference between the wheels and the steel structure foundation frame.

5. The clevis bracket and wheel assemblies of the instant invention may be advantageously repeatedly used following a single alignment calibration, thereby avoiding roller derailments. With a single wheel alignment and calibration, the rack gear and the moving wheel assembly may operate with stability during repeated and successive cycles of pumping unit withdrawal and return.

BRIEF DESCRIPTION OF THE DRAWINGS

In order to illustrate a suitable mode of implementation of the invention, Drawing

FIG. 1 is a perspective view of the inventive belt pumping unit moving device.

FIG. 2 is a magnified view of a portion of the structure of FIG. 1.

FIG. 3 is a perspective view of motor power unit components.

FIG. 4 is a schematic diagram showing pivoting disengagement motion limiting structures.

FIG. 5 is a magnification of area "D" in FIG. 4.

FIG. 6 is a side view of the FIG. 1 structure.

FIG. 7 is a perspective view of a moveable clevis bracket and wheel assembly.

FIG. 8 is a magnification of area "B" of FIG. 6.

FIG. 9 is a perspective view of the FIG. 8 structure.

FIG. 10 presents an alternate downwardly extended configuration of the FIG. 8 structure.

FIG. 11 is a perspective view of the FIG. 10 structure.

FIG. 12 is a further alternate configuration of the FIG. 8 structure.

FIG. 13 is a magnification of the area "A" of FIG. 12.

FIG. 14 is an end view of the FIG. 6 structure.

FIG. 15 is a magnification of area "C" in FIG. 14.

Figure 1:
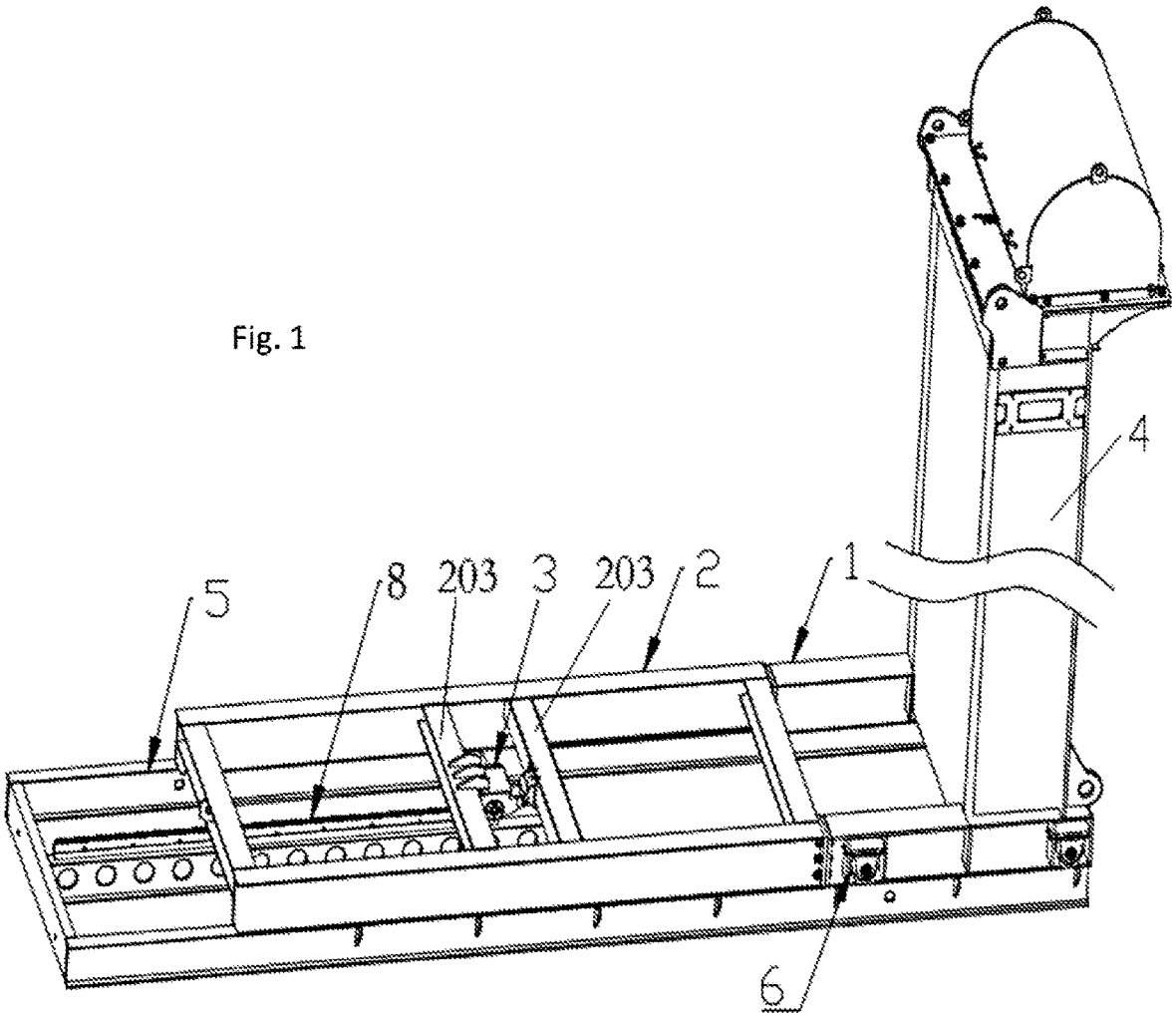
FIGS. 1-15 are briefly introduced below. The drawings are only exemplary. For ordinary technicians in the art, other modes of implementation can be obtained according to the mechanical objects disclosed without creative work.

The reference numerals in the figures are identified as follows:

1) Rolling forward portion of upper base; 2) Rearward extension of upper base; 3) Rotary power unit; 4) Belt adapted tower pumping unit; 5) Lower steel structure foundation frame; 6) Vertically moveable clevis bracket and wheel assembly; 7) Downward extension locking shim plate; 8) Rack gear; 101) Weight bearing wall; 102) Support plate; 103) Travel slots; 201) Adjustment screw mount; 202) Adjustment screws; 203) Crossbeams; 301) Clevis hinge; 302) Pivot frame; 303) Hinge pin; 304) Pinion gear; 305) Motor; 306) Gear support plates; 501) Guide tracks; 601) Clevis bracket; 602) Travel guiding lugs; 603) Rollers or wheels; 701) Support rod fixing seat; 702) Support rod; 703) Stop block; 704) Protective spring; 705) Telescoping sleeve; 801) Rack gear support base; 802) Rack gear support seat; 803) Rack gear; 901) Screw mount; 902) Horizontal screw; 903) Contact element base; 904) Contact roller; 905) Roller mounts; and 906) Screwhead.

DETAILED DESCRIPTION

Figure 2:
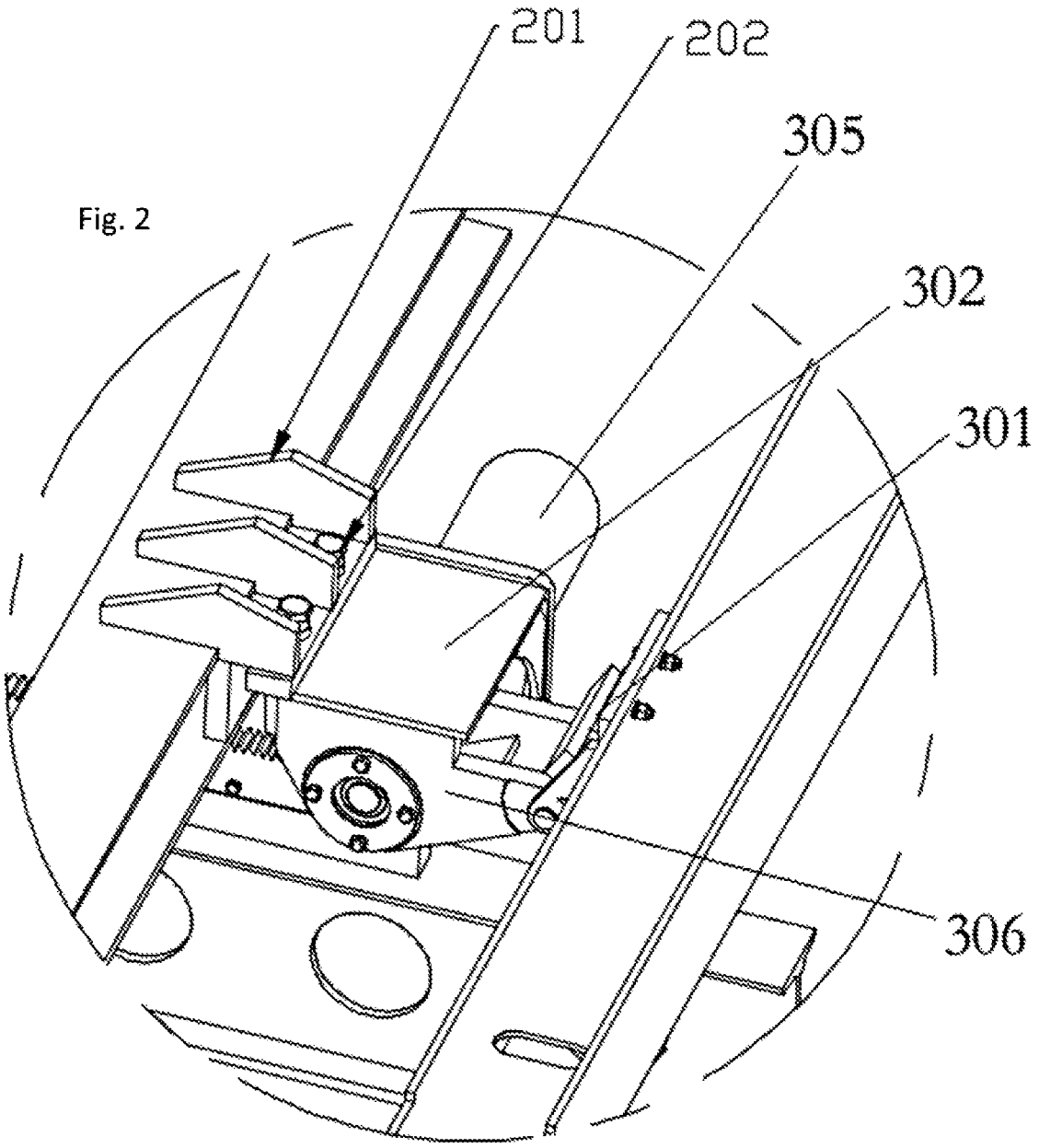
Figure 3:
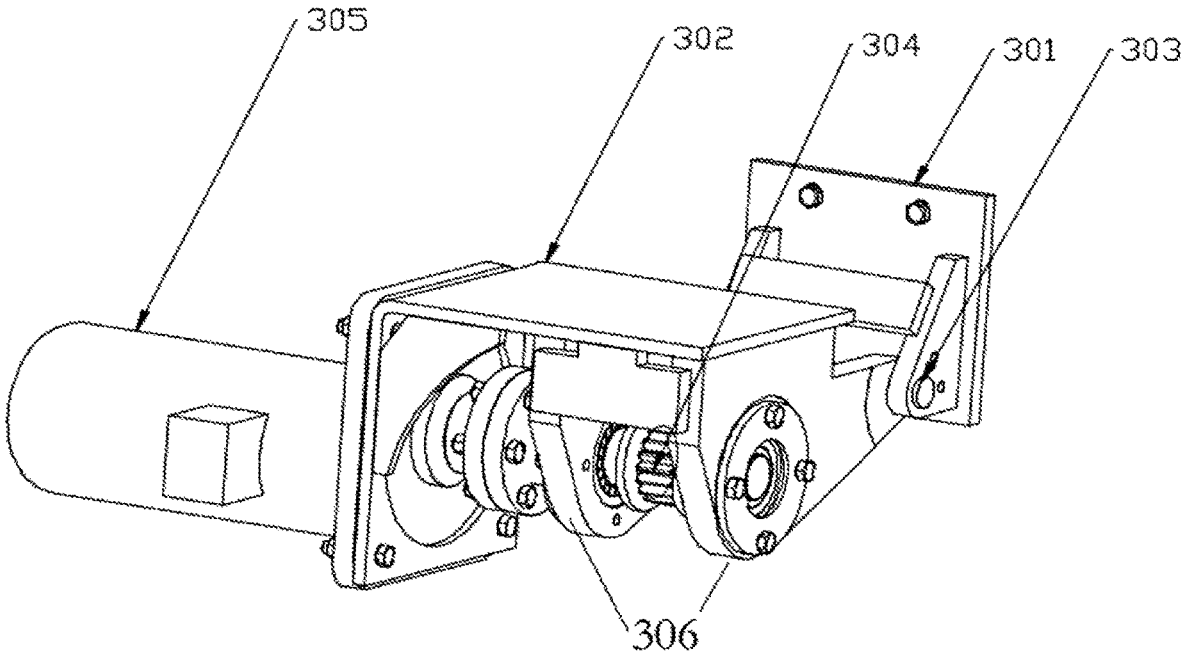

The invention provides a belt pumping unit moving device. As shown in FIGS. 1-3, the device comprises a rack gear 8, an upper and rollable front frame 1, and a rigidly attached rearward extension of the upper frame 2. The front frame 1 and rear extension 2 are mounted above an underlying steel structure foundation frame 5. The rolling front frame 1 and rear extension 2 can be tightly attached to or raised slightly upwardly from the steel structure foundation frame 5.

A belt pumping unit 4 is mounted upon the rolling front frame 1, and at least four notches or wheel wells are formed as integral parts of the rolling frame 1. Vertically extendable and retractable wheel assemblies 6 configured as clevis bracket and wheel combinations are provided. Such wheel assemblies 6 may be fixed in raised or lowered positions, the wheel assemblies 6 being vertically adjustable and capable of being securely fixed in place at desired position. Downward extensions of the wheels 603 and their clevis brackets 601 allow the upper frame components to roll along the steel structure foundation frame 5.

A rack gear 8 is mounted within the lower steel structure foundation frame 5, such gear being located immediately below the rear portion 2 of the upper moveable base. The upper base 2 is equipped with a motor power unit 3 which rotatably drives a pinion gear 304. Such gear 304 may mesh with and engage the rack gear 8 to drive the upper base 1,2 horizontally along the underlying steel structure frame 5. The structure of the motor power unit 3 is not limited, provided that the motor power unit and the rack gear 8 can engage each other to horizontally drive the upper frame 1,2 and the belt unit 4.

In order to improve the stability of the assembly during use in moving the pumping unit 4, the motor power unit 3 suitably comprises an ear plate or clevis hinge 301, a "C" channel configured moving or pivoting frame 302, a connecting shaft or hinge pin 303, a pinion gear 304, a motor 305, and two gear support plates 306. The gear support plates 306 are respectively arranged at opposite axial ends of the pinion gear, such plates extending downwardly as arm components of the "C" channel configured pivot frame 302. The motor 305 is installed and laterally supported upon one of the two gear support plates 306 by a rotating shaft, one end of the rotating shaft being connected with the output shaft of the motor 305. Proximal ends of the two gear support plates 306 are pivotally connected to the ear plate or clevis hinge 301 by a hinge pin 303. Crossbeams 203 span laterally across the upper moving frame 2, and the clevis hinge 301 is mounted upon one of the crossbeams 203. Angular motions of the pivoting frame 302 in the vertical direction may be selectively adjusted so that the pinion gear 304 may mesh with or disengage from the rack gear.

At a commencement of use of the instant inventive assembly for moving the pumping unit 4, and while the position of the distal end of the pivot frame 302 in the vertical direction is downwardly adjusted so that the pinion gear 304 meshes with the underlying rack gear 8, the motor 305 may be actuated, movement of the pumping unit 4 being thereby quickly achieved.

While the pumping unit 4 is in operation, the pinion gear 304 and the rack gear 8 are preferably vertically separated. In such non-use configuration, the gear support plates 306 and the clevis hinge 301 are fixed by a hinge pin 303 which allows the vertical position of the pinion gear 304 to be quickly adjusted. By adjusting the angular position of the pivot frame 302, the distance between or contacting engagement of the pinion gear 304 and the rack gear 8 can be quickly selectively achieved.

In the above described modes of mechanical implementation, pivoting adjustment of the pivot frame 302 may be achieved a variety of mechanical ways. In the suitable FIG. 2 embodiment, a screw adjustment bracket 201 is welded onto the other or proximal crossbeam 203, and threaded apertures are formed within the screw adjustment bracket 201. Such threaded apertures receive adjustment screws 202 whose lower ends threadedly engage the distal end of the pivot frame 302. Upon rotations of the screws 202, the vertical position of the distal end of the pivot frame 302 may be selectively adjusted. By turning screws 202, the distance between the pinion gear 304 and the rack gear 8, or such components' contact with each other, may be quickly achieved, thereby further improving the moving efficiency.

Figure 4:
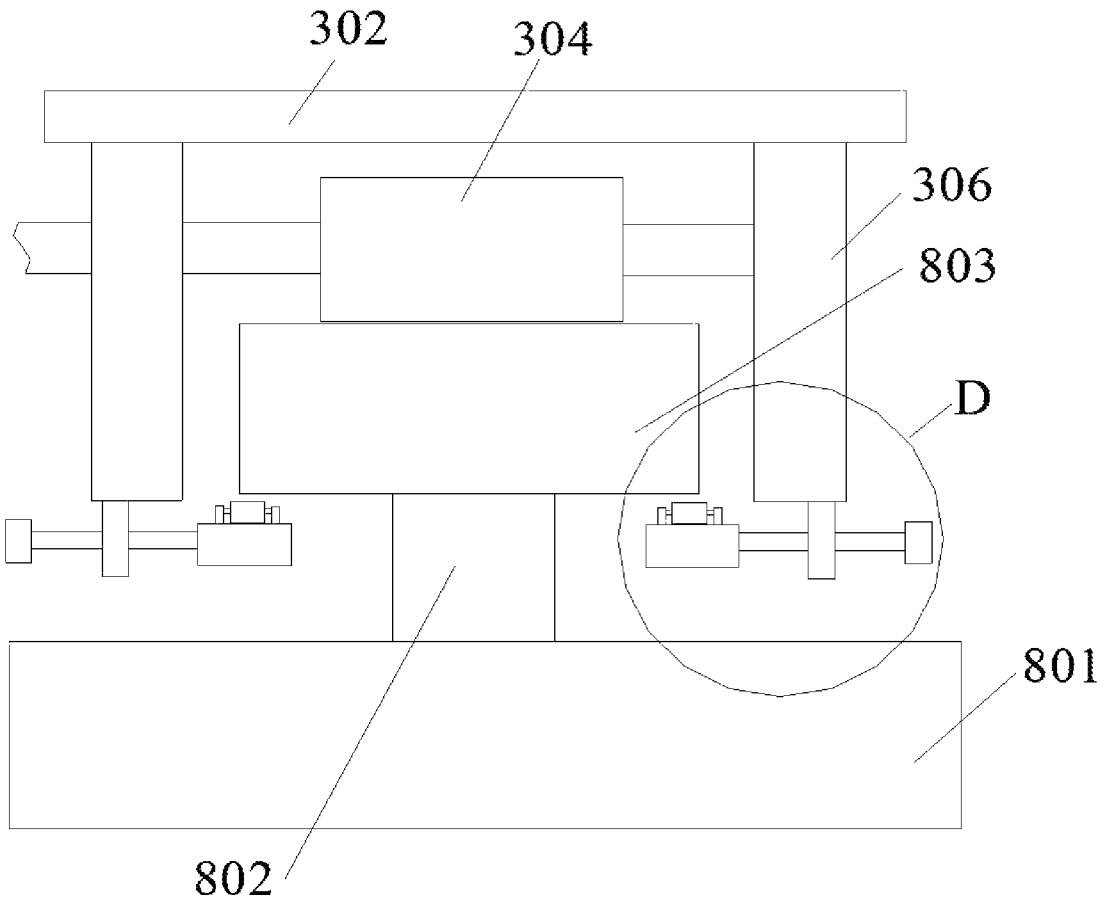

The gear support plates 306, in addition to their performance of the function of fixedly positioning the pinion gear 304, operate to improve the stability of the pinion gear 304 in the process of moving. As shown in FIG. 4, when the pinion gear 304 meshes with the rack gear 8, the top of the rack gear 8 is securely held between the two gear plates 306. Therefore, the gear support plates 306 perform functions of guiding and limiting the position of the pinion gear 304, effectively preventing such gear from becoming detached from the rack gear 8, and lessening the risk that the upper moveable base 1,2 may misalign with underlying the steel structure foundation frame 5.

Figure 5:
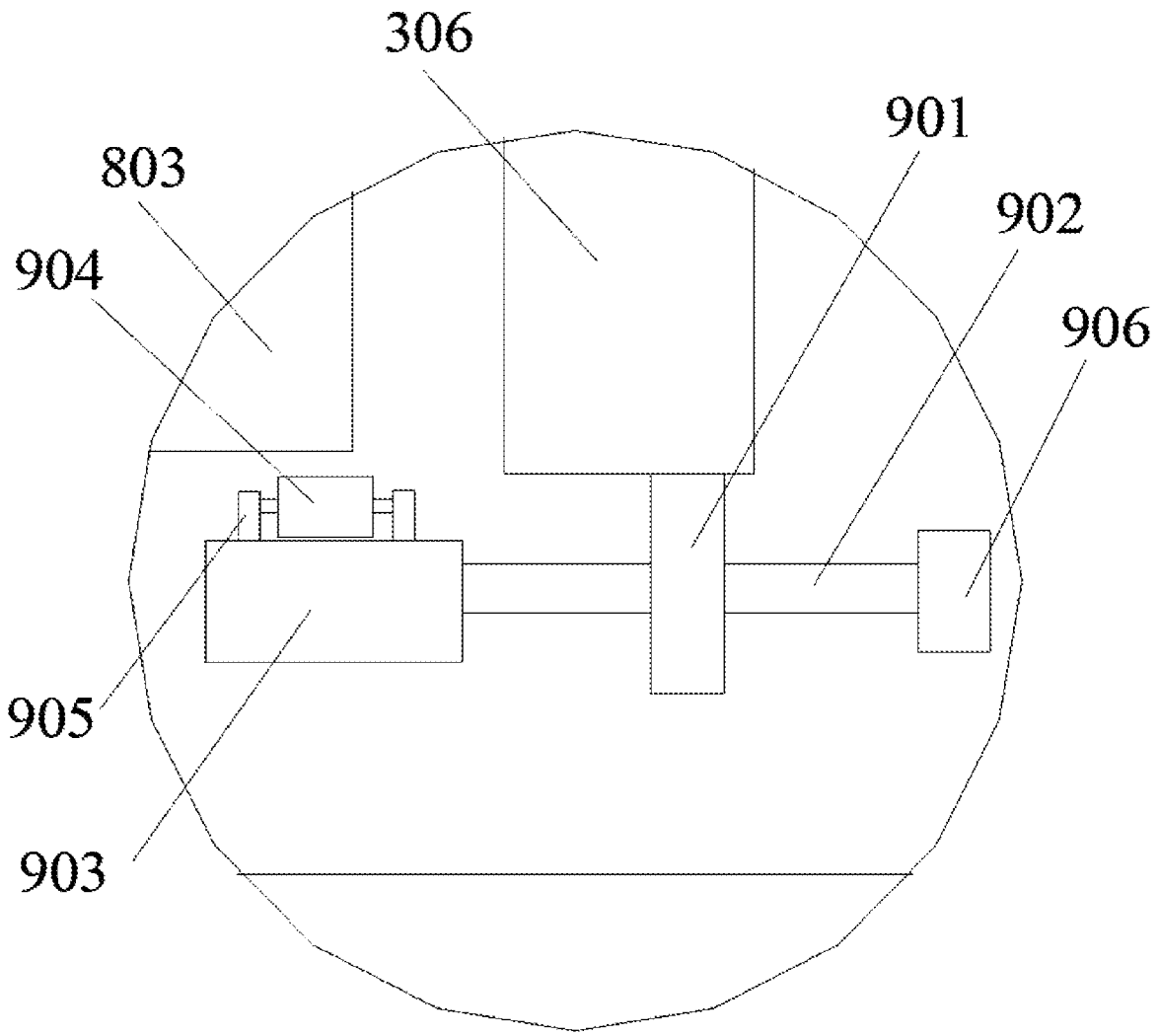
Figure 6:
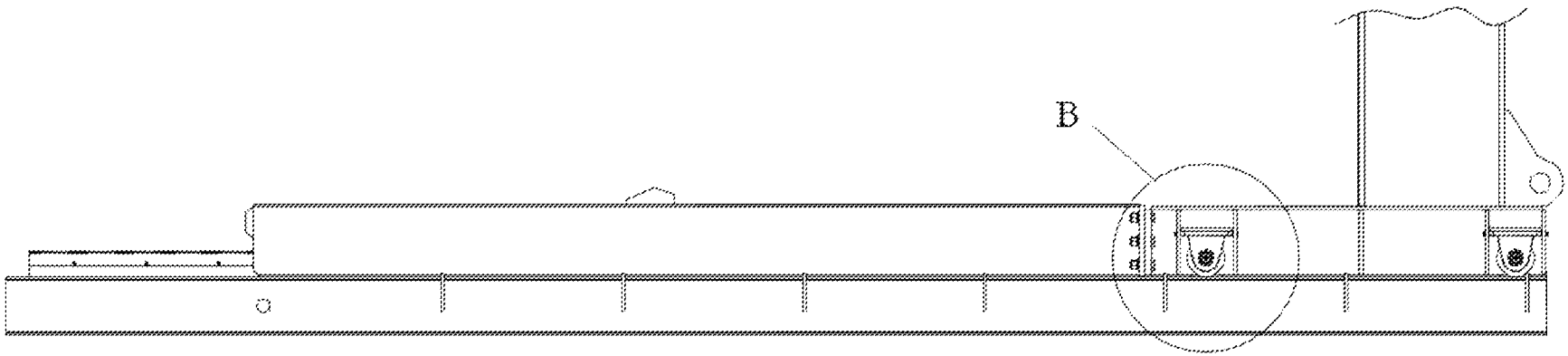
Figure 7:
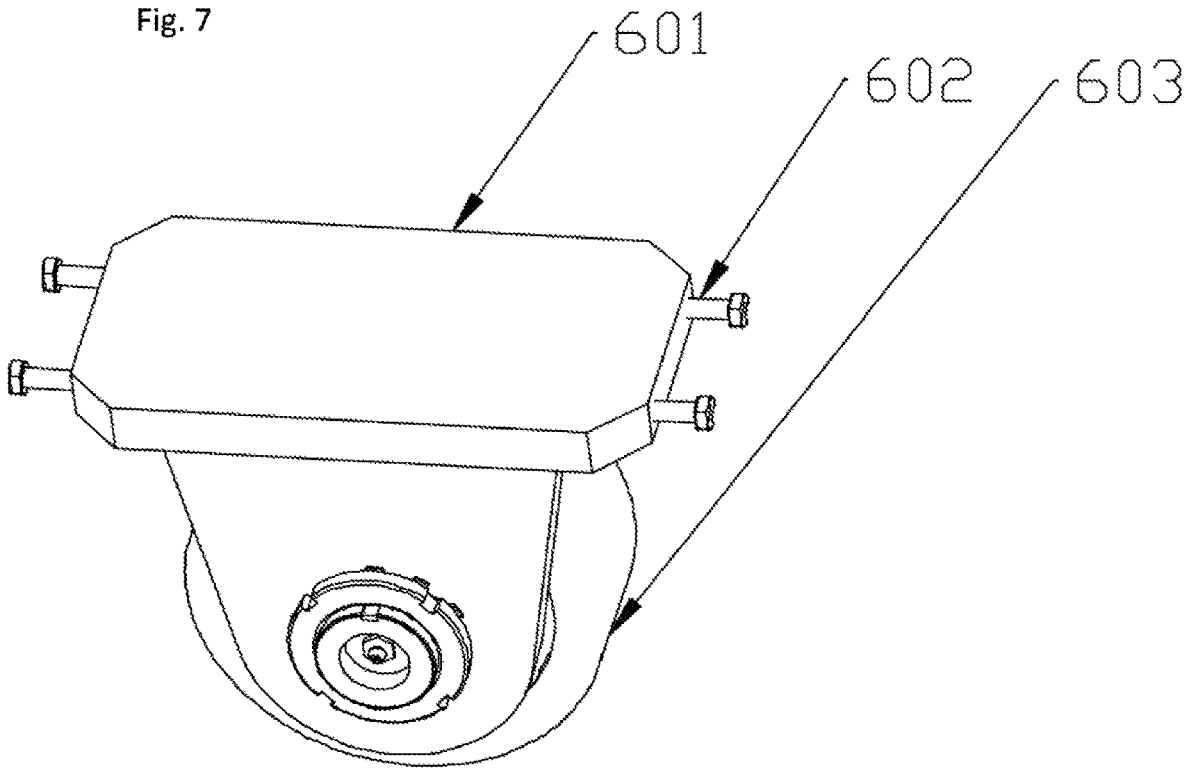
Figure 8:
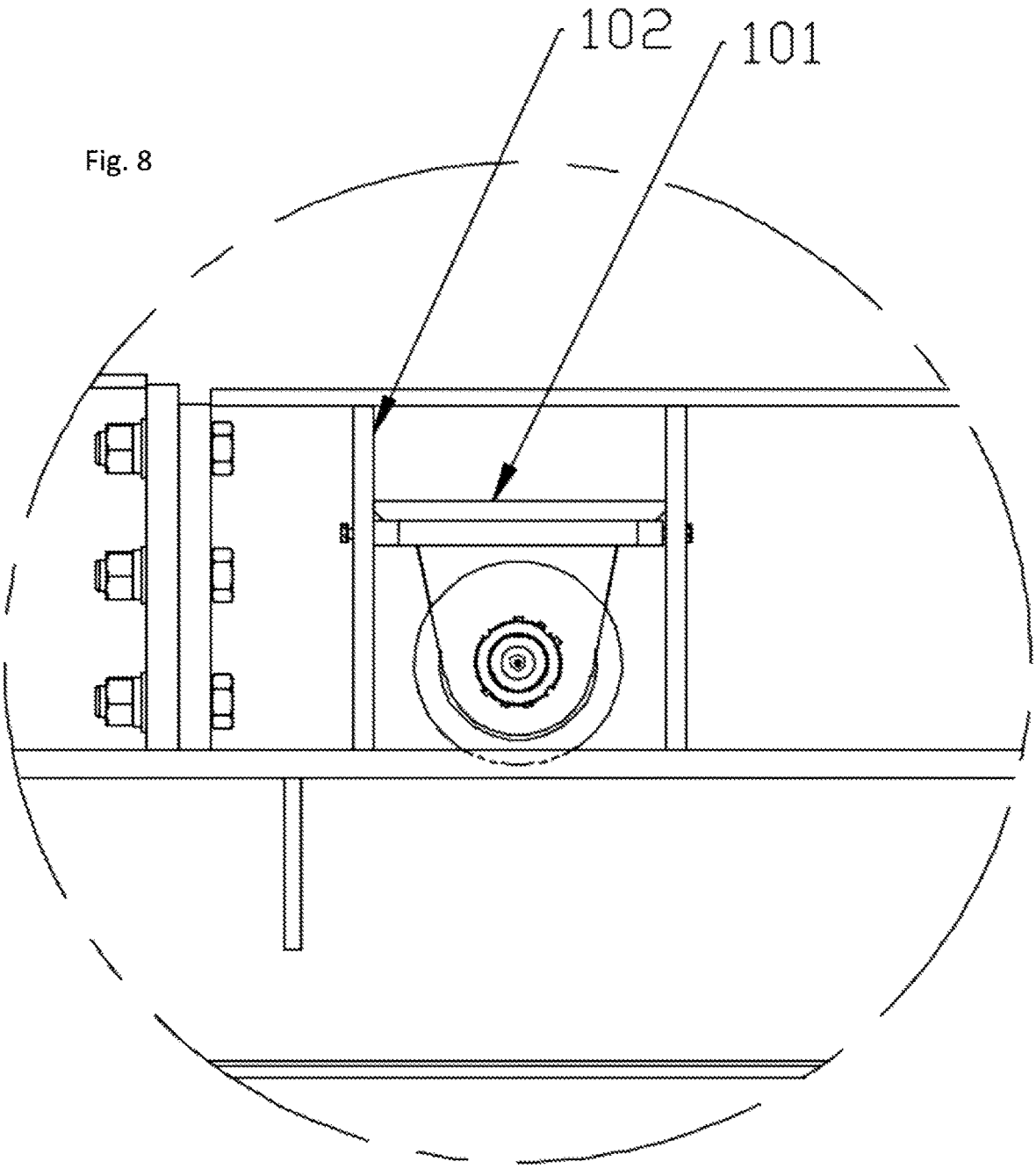
Figure 9:
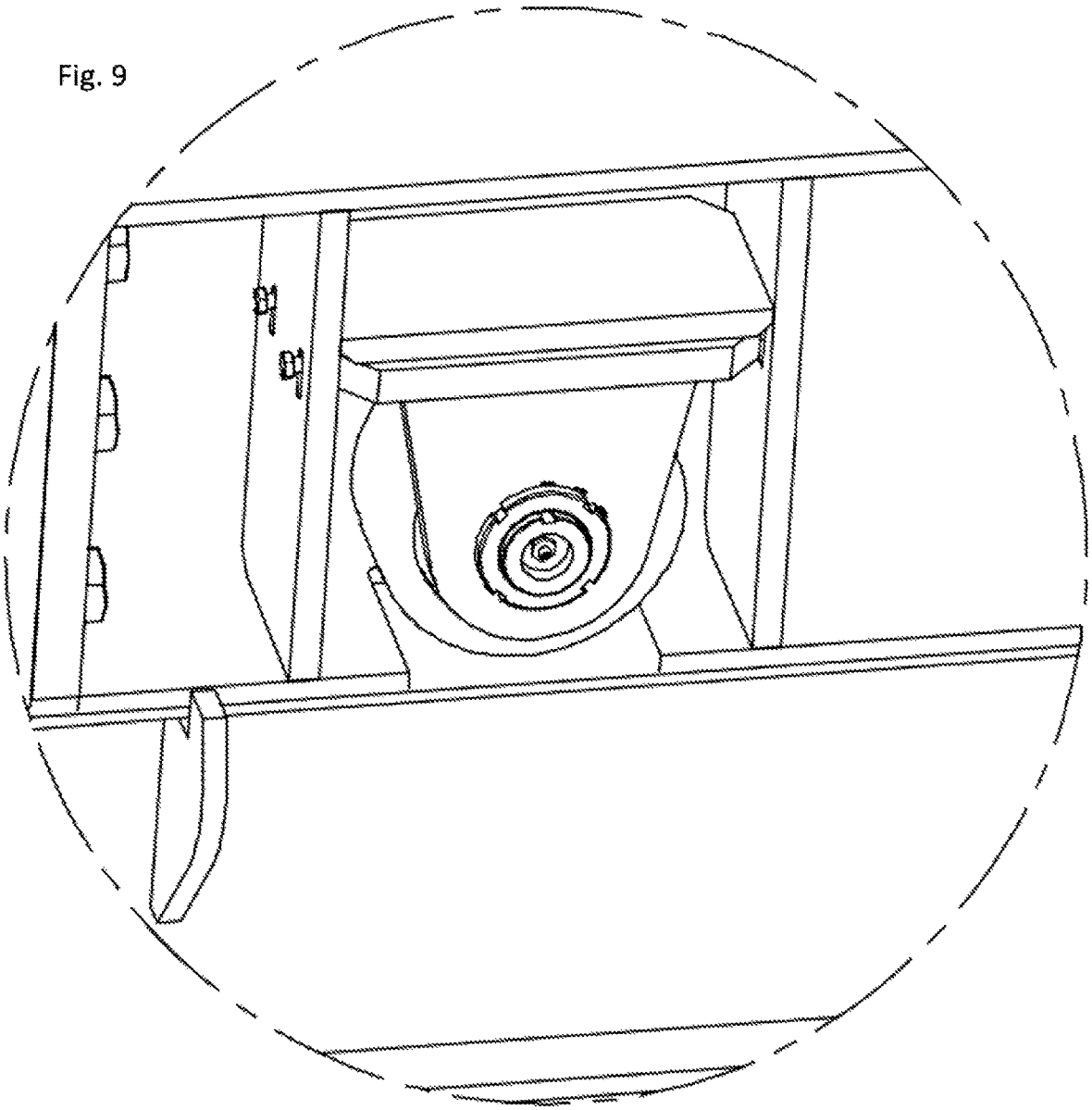
Figure 10:
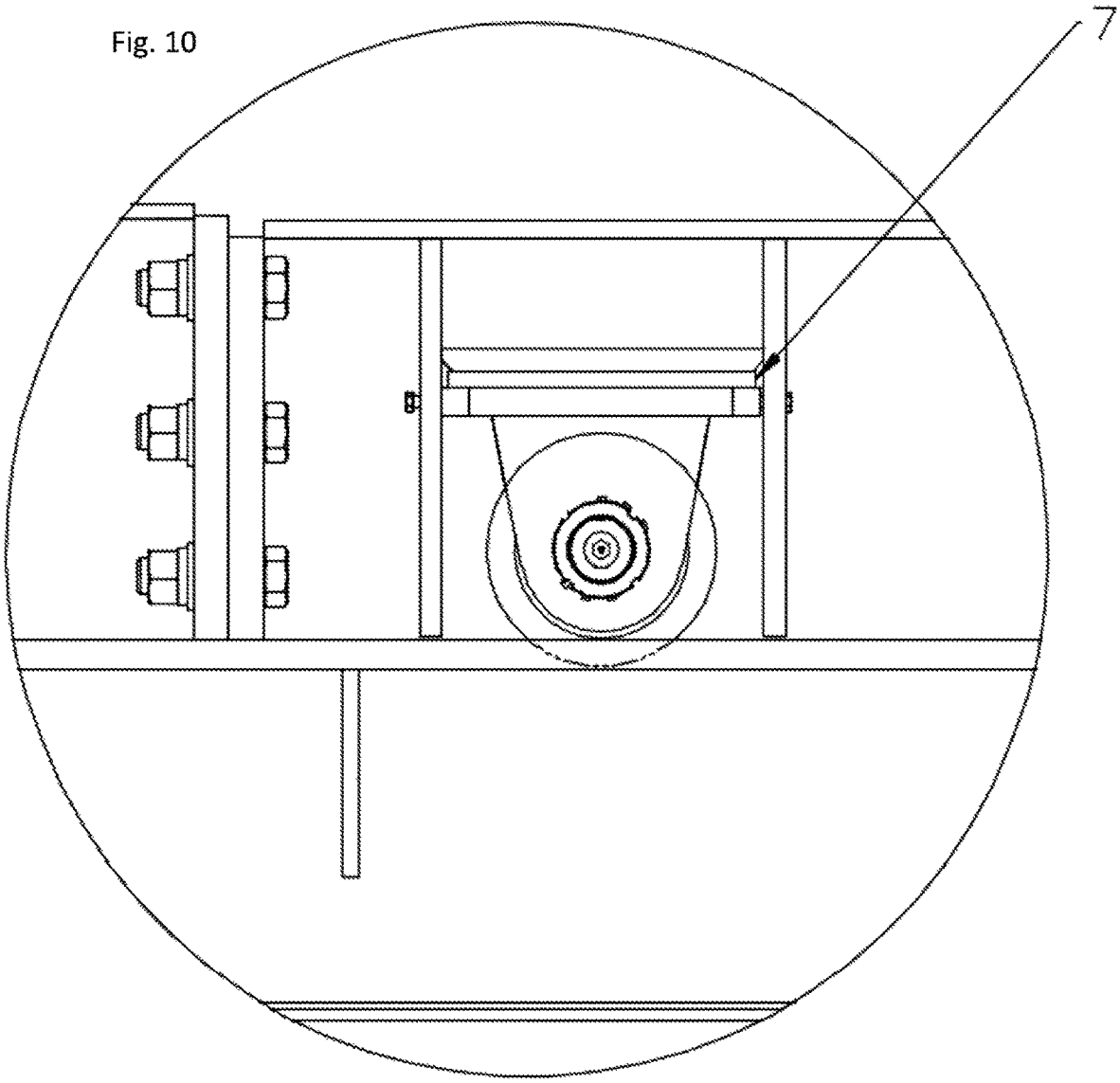

Referring to FIGS. 4 and 5, in order to further improve the stability of the device during belt unit moving operation, the upwardly extending teeth of the rack gear 8 are suitably supported by a gear base 801, a gear support seat 802, and gear body 803, such components being mounted upon the lower frame 5 and being connected sequentially from bottom to top. Laterally opening channels are formed between the upper surface of the gear base 801 and the lower surface of the gear body 803, and the lower ends of gear support plates 306 are equipped with horizontally extendable and retractable pivot limiting stops. When the pinion gear 304 meshes with the rack gear 8, such pivot limiting assemblies may be horizontally extended to underlie the gear body 803. Upon such pivot limiting extension, the gear support plates 306 perform a function of limiting position both in the horizontal and vertical directions, contact elements 903, 904, and 905 functioning with the plates 306 to limit angular pivoting of the pinion 304 in the vertical direction. The mechanical performances of such functions avoids undesirable phenomena wherein the motor power device 3 becomes displaced from the rack gear 8 in the process of moving the machine.

In the above described mode of implementation, the structure of the pivot limiting assembly is not specifically defined. As shown in FIG. 5, the limit assembly suitably comprises horizontal screw shafts 902 extending to contact element bases 903. Screw mounts 901 attached beneath the gear support plates 306 threadedly receive the screws 902. The contact element bases 903 may extend beneath the gear body 803 to limit upward pivoting travel of the pinion gear 304. While there is no need for moving the pumping unit, the limit base 903 may be laterally retracted from beneath the gear body 803 by counter-turning the screws 902. During the process of moving the belt unit 4, and while the screws 902 operatively hold the contact base 903 beneath the gear body 803, pivot limiting is effectively achieved.

Referring further to FIG. 5, in order to assure that the motor power unit 3 is not subjected to excessive resistance during operation, the base 903 may be equipped with contact rollers 904 supported by axle mounts 905. Such arrangement of components allows the contact rollers 904 to establish rolling contacts between the pivot limiting bases 903 and the rack gear body 803. Frictional contacts between the bases 903 and the rack gear body 803 are advantageously minimized by the rollers 904 so that the motor power unit 3 runs smoothly. Referring further to FIG. 5, in order to facilitate the rotations of the screws 902, an ends of the screws 902 are equipped with a faceted screwheads 906.

Referring to FIGS. 6-9, the vertically adjustable wheel assemblies 6 are supported between vertically extending flanges or connecting plates 102 which are vertically arranged at opposite ends of wheel well functioning gaps. Travel slots 103 extend horizontally through the connecting plates 102, and overlying baffles or bearing walls 101 immediately overlie the travel slots. Each wheel assembly 6 suitably comprises a clevis bracket configured wheel frame 601 having travel guiding bolts or lugs 602, the wheels 603 of such assemblies being rollably mounted within the clevises 601. Longitudinal ends of the guide lugs 602 pass through the travel slots 103, such lugs being mounted at both longitudinal ends of the clevis brackets 601. Accordingly, the wheel assemblies 6 are capable of vertically moving along the travel slots 103. Position locking shim plates 7 are arranged between the bearing walls 101 and the upper ends of the clevis brackets 601, the shim plates 7 being capable of downwardly extending the wheel assemblies 6 so that the upper frame 1 may be securely rollably raised above the underlying steel structure foundation frame 5.

Upon establishment of a clearance gap between the upper frame 1 and the underlying steel structure foundation frame 5, workers operating the assembly may insert the shim plates 7 so that the wheel assemblies are held downwardly with respect to the travel slots 103. The downwardly extended positions of the wheel assemblies are thereby fixed by the position adjusting shims 7, causing the rollers 603 to be stably supported on the steel structure foundation frame 5. Thereafter, the lifting equipment used to initially raise the belt pumping unit may be removed, and the weight of the upper frame 1 and the belt pumping unit 4 may be uniformly supported upon the steel structure foundation frame 5 by the plurality of rollers 603. Provision of a uniform weight distribution to the rollers 603 lessens the risk of frictional damage to individual rollers.

The mechanical cooperation between the connecting plates 102, the bearing walls 101, the extension fixing shims 7, and the moving wheel assemblies 6 can adjust and fix the relative vertical positions of the wheels efficiently and stably, thereby further ensuring the stability of the device in the process of moving the machine. The structure of the shim plates 7 is not specifically defined, and such shims may comprise durable elastomeric cushioning blocks.

While the upper frame 1 is raised by a jack, a gap exists between the upper frame 1 and the steel structure foundation frame 5, and the wheel assemblies 6 are free to fall downwardly under the action of gravity. Thereafter, workers may fix the wheels 603 at their downwardly extended positions by extending the shim plates 7 between the clevis brackets 601 and the bearing walls 101. Thereafter, the lifting device may be removed.

Figure 11:
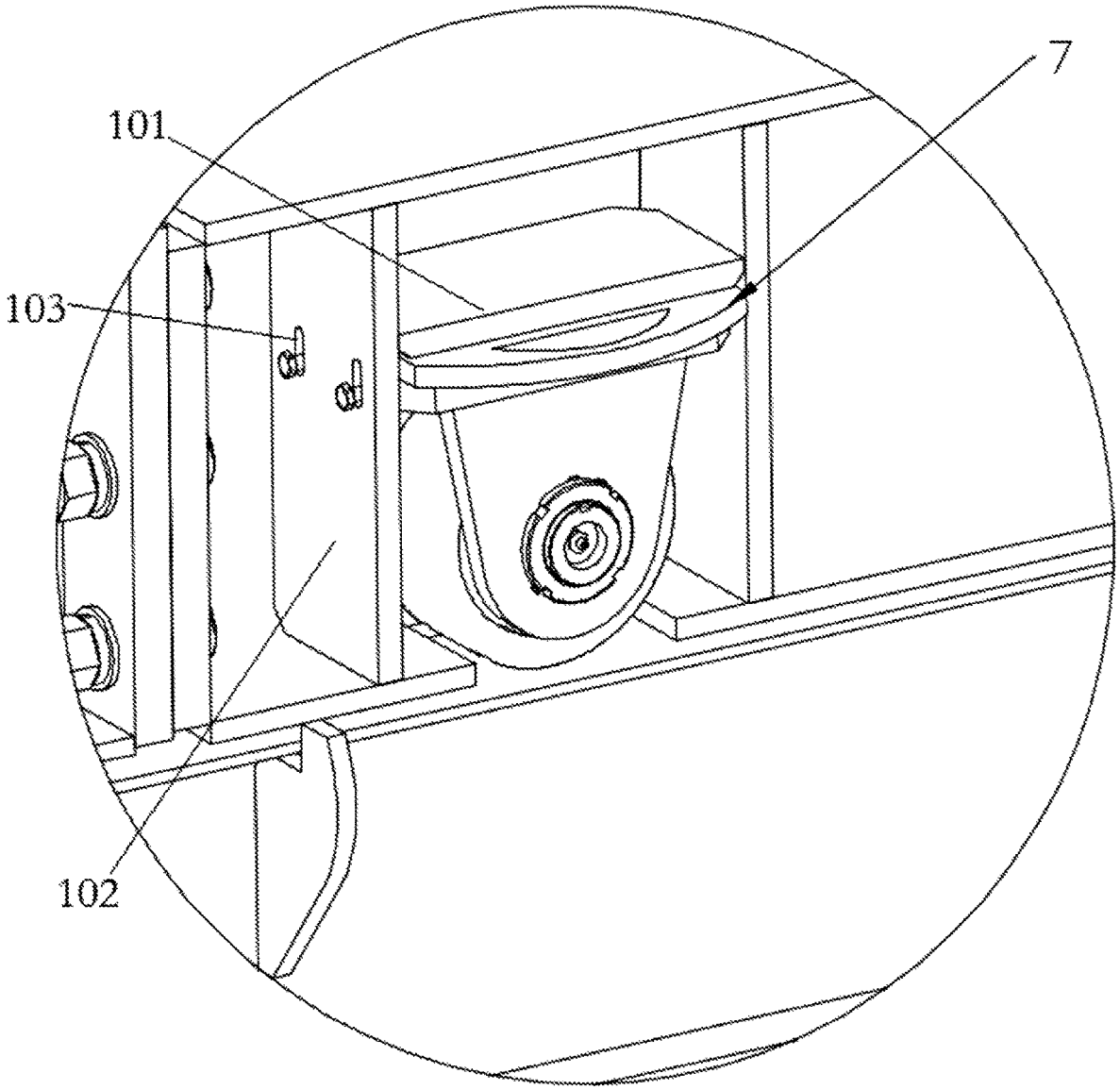

As shown in FIG. 11, in order to facilitate the placement of the shim plates 7 between the bearing walls 101 and the clevis brackets 601, and to facilitate the removal of such shim plates, the laterally outer ends of the shim plates may protrude laterally. A handle loop may be formed on the laterally protruding ends of the shim plates, the handle assisting manipulations of the plates.

Figure 12:
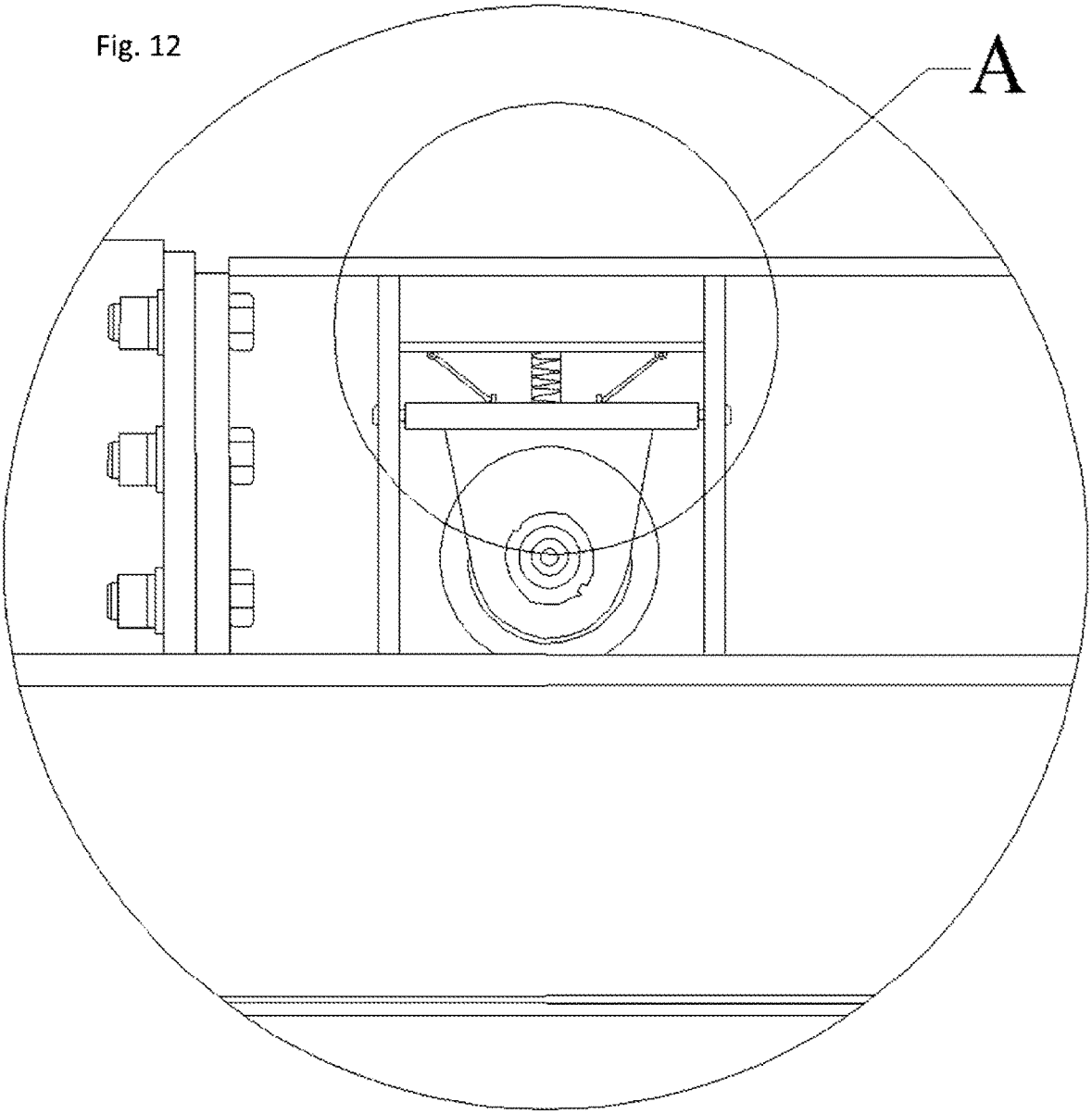
Figure 13:
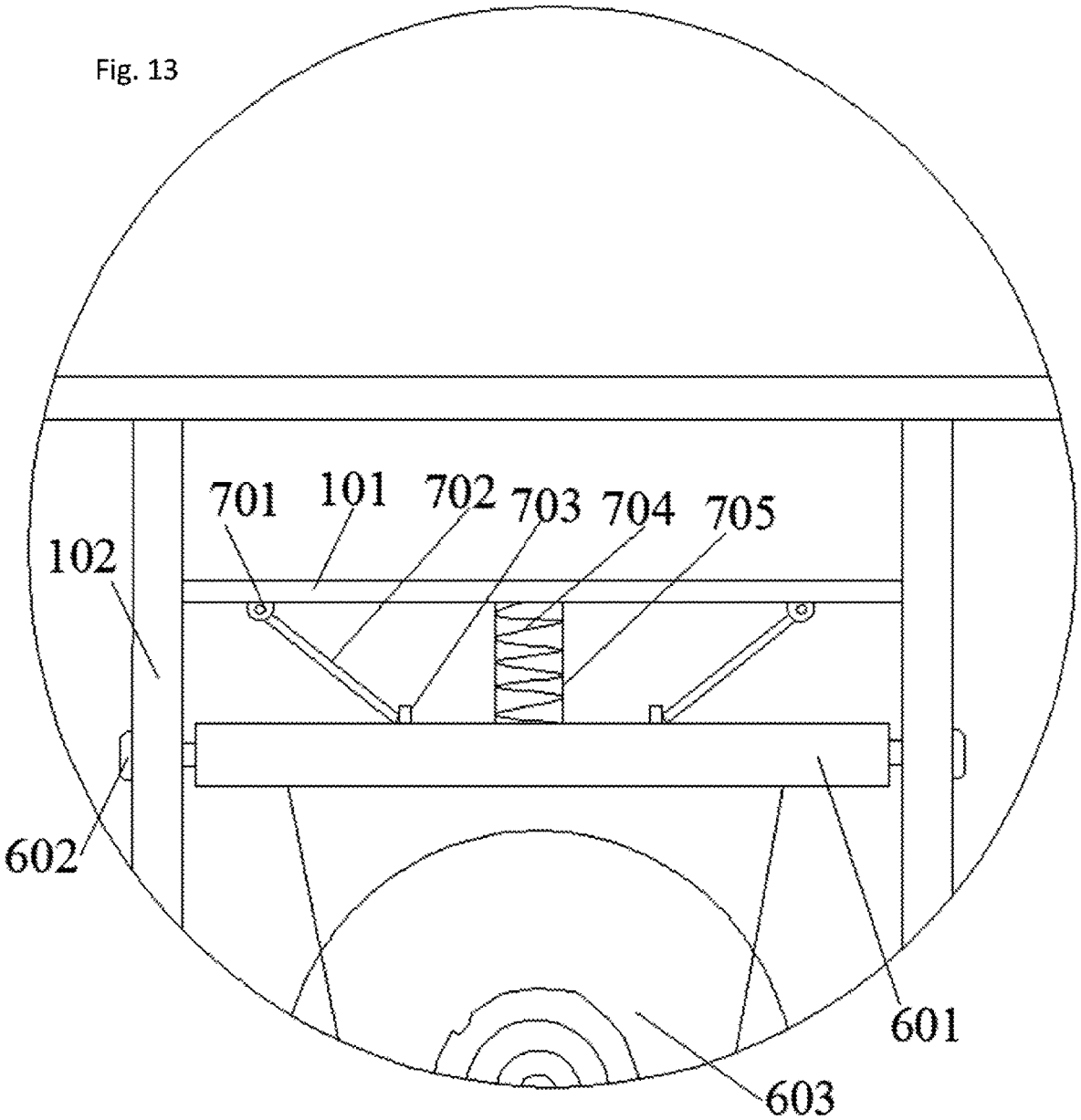

The shim plates 7 are depicted, for example, in the form of cushioning blocks. Notwithstanding, such elements suitably have other structural forms. While the shim plates 7 have the advantages of mechanical simplicity and low production cost, they require separate storage and may be easily misplaced or lost. Also, during the process of moving the machine, vibration may cause the shim plates to fall from beneath the bearing walls 101. Referring to FIGS. 12 and 13, to address such problems, vertical motion actuating assemblies may be provided, such assemblies including support rod fixing seats or hinges 701. The support rod fixing hinges 701 are mounted upon the bottom of the bearing wall 101, and support rods 702 are pivotally connected at the hinges 701. The lower ends of the support rods 702 may engage the top of the clevis bracket 601. Where operation of the FIGS. 12,13 actuator is needed, the vertical position of the wheel assembly 6 may be stably fixed by pivoting the support rods 702 and by anchoring such rods upon the clevis brackets. Upon completion of such operation, the position adjusting mechanisms 701,702 do not need to be stored separately, lessening the risk of loss. Such arrangement of components also advantageously avoids the risk that components may fall from between the bearing walls 101 and the clevis brackets 601 in the process of moving the machine.

Referring to FIGS. 12 and 13, the support rods 702 may also be fixed in a variety of ways on the top of the clevis brackets 601, which are not specifically described. In order to promote convenience of operation and stability, stop blocks 703 may be mounted on the top of the clevis brackets 601, the lower ends of the support rods 702 being capable of contacting and being fixed against the stop blocks 703. Thus, the stop blocks 703 may provide strong support to the support rod 702, improving the stability of the operation of the moving wheel frame 601 during the moving process.

Instead of incorporating stop blocks 703, the upper ends of the clevis brackets 601 may alternatively adopt other structures capable of fixedly holding the supporting rods 702. In order to simplify the structure, the upper ends of the clevis brackets 601 may include rod end capturing grooves or slots.

Upon jack actuated lifting of the upper base 1,2, the wheel assemblies may violently fall against the lower base 5, potentially damaging the wheel assemblies. Referring to FIGS. 12 and 13, in order to avoid such occurrences, protective springs 704 may be arranged between the bearing walls 101 and the clevis brackets 601. Through the force of the springs 704 exerted against the clevis brackets 601, the moving wheel assemblies 6 may be effectively prevented from violent falling. A calibrated limitation of the force or constants of the springs 704 may also ensure that the clevis brackets 601 are capable of downward movement under gravity.

In order to protect the springs 704, sleeves 705 surrounding the springs 704 may be provided. Such sleeves 705 may be telescoping with opposite ends of the sleeves being connected to the bearing walls 101 and to the clevis brackets 601. In order to avoid non-elastic deformations of the springs 704, the telescoping sleeves 705 can limit deflections of the spring to motions within their elastic range, thereby increasing the service lives of the springs 704.

Figure 14:
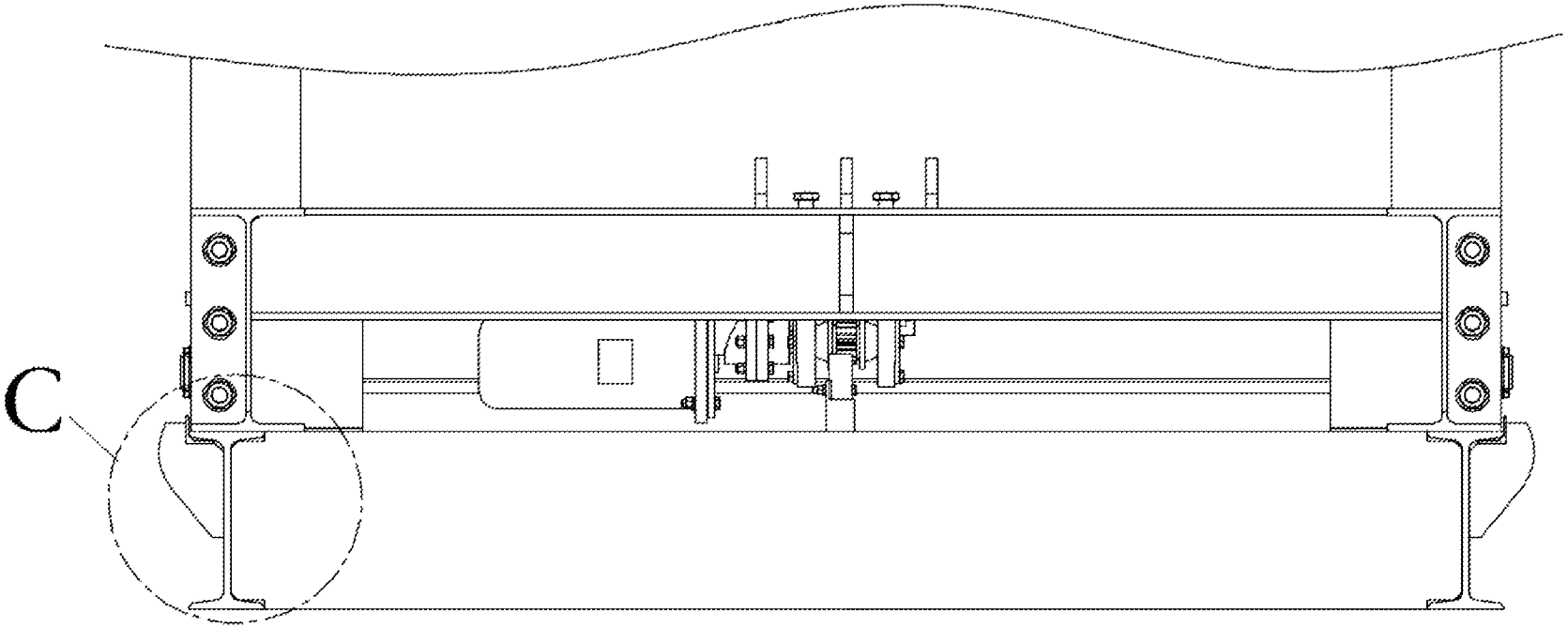
Figure 15:
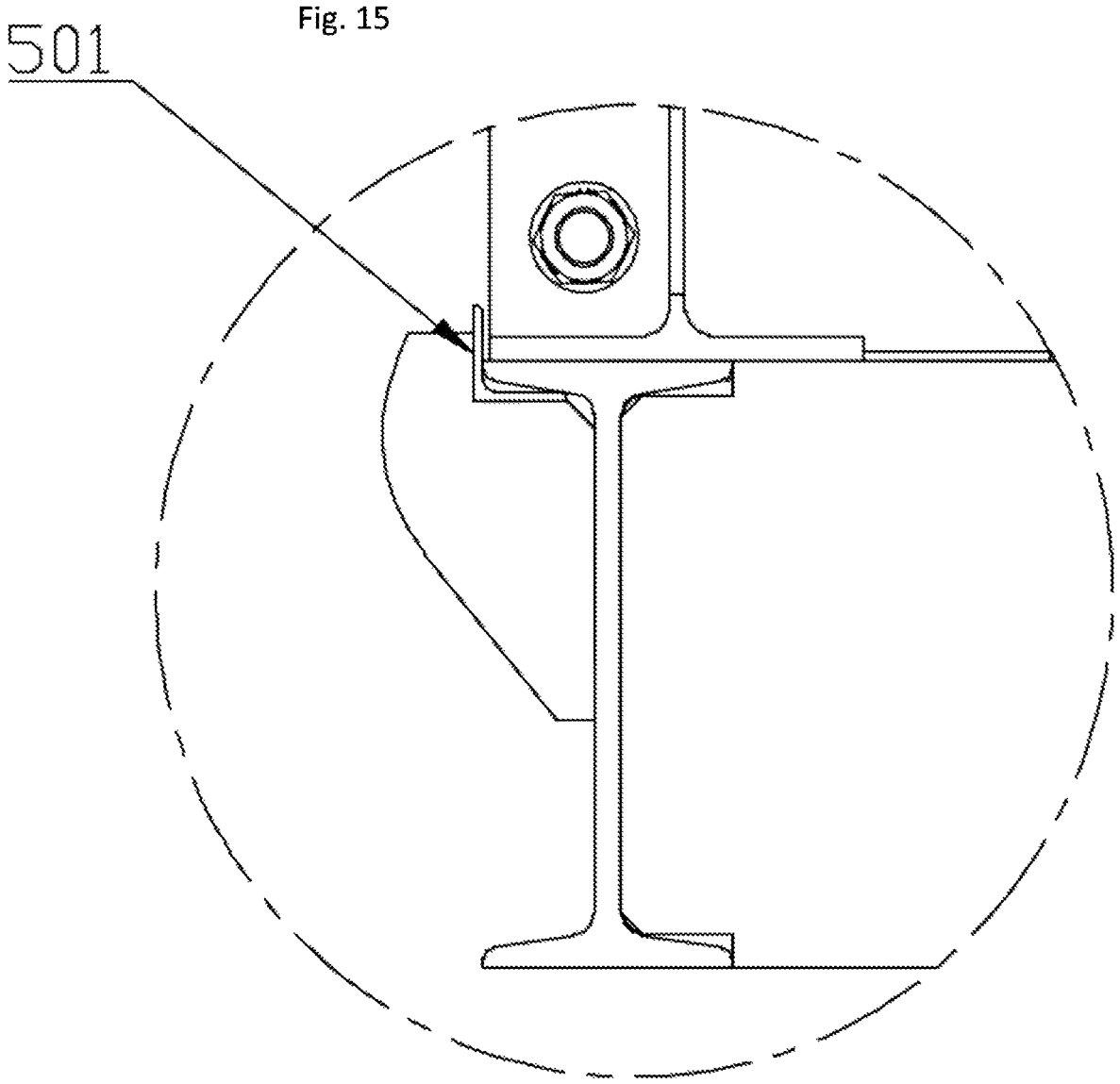

Referring to FIGS. 14 and 15, in order to further ensure that the roller assemblies 603 are able to move stably on the steel structure foundation frame 5, the top of the steel structure foundation frame 5 may be equipped with a guide track or flange 501, the rollers 603 being capable of longitudinal rolling motions within the guide tracks 501. The tracks 501 perform a beneficial component guiding function which avoids the derailments of the rollers 603.

The orientations of the bearing walls 101 may be selected in a wide range. Notwithstanding, in order to improve the surface contacts between the bearing walls 101 and the clevis brackets 601, the bearing walls 101 are preferably oriented horizontally. Upon such orientation, and while the pumping unit 4 is operating, the bearing walls 101 and the clevis brackets 601 remain in contact, assuring that the wheel assemblies 6 are held with stability within their well spaces. According to the scope of the instant invention, there is no specific requirement for the number and distribution of wheel wells and wheel assemblies. Notwithstanding, in order to save costs and to ensure that the forward end 1 of the upper base provides sufficient stability to the belt unit 4, two longitudinally spaced wheel wells are preferably provided on each lateral side of the frame 1.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A belt pumping unit moving assembly comprising:

(a) a lower base;

(b) a rack gear fixedly attached to the lower base;

(c) an upper base overlying the lower base, the belt pumping unit being fixedly attached to the upper base;

(d) a motor and pinion gear combination, said combination's motor being mounted upon the upper base, and said combination's pinion gear being engageable with the rack gear;

(e) a plurality of wheels or rollers mounted upon the upper base wherein, upon engagement of the pinion gear with the rack gear and upon actuation of the motor, the upper base and the belt pumping unit rollably move along the lower base; and (f) a pivot bracket spanning between the upper base and the motor and pinion gear combination, said pivot bracket being adapted for alternatively engaging the pinion gear with the rack gear and disengaging the pinion gear from the rack gear.

2. The belt pumping unit moving assembly of claim 1 wherein the pivot bracket has a proximal end hingedly connected to the upper base, and has a distal end, and further comprising a vertical screw actuator connected operatively to said distal end, said vertical screw actuator being adapted for raising and lowering the distal end of the pivot bracket.

3. The belt pumping unit moving assembly of claim 2 wherein the pivot bracket comprises a pair of gear support plates, the pinion gear being rotatably mounted upon said plates.

4. The belt pumping unit moving assembly of claim 3 further comprising a pivot stop assembly operatively spanning between the gear support plates and the rack gear, the pivot stop assembly being adapted for, upon operation of the vertical screw actuator to upwardly pivot the pivot bracket and the pinion gear away from rack gear, limiting such upward pivoting.

5. The belt pumping unit moving assembly of claim 4 wherein the pivot stop assembly comprises a contact element which is moveable between a rack gear engaging position and a rack gear clearing position.

6. The belt pumping unit moving assembly of claim 5 further comprising a horizontal screw actuator adapted for moving the pivot stop assembly's contact element between the rack gear engaging and clearing positions.

7. The belt pumping unit moving assembly of claim 1 further comprising a plurality of clevis brackets operatively interconnecting the wheels or rollers and the upper base.

8. The belt pumping unit moving assembly according to claim 7 wherein the clevis brackets are adapted for vertical movements between base support positions and disengaged positions, the clevis brackets and wheels or rollers moving upwardly with respect to the upper base upon movements toward their disengaged positions.

9. The belt pumping unit moving assembly of claim 8 further comprising a plurality of vertical motion actuators operatively spanning between the upper base and the clevis brackets, said actuators being adapted for moving the clevis brackets and the wheels or rollers between the base support and disengaged positions.

10. The belt pumping unit moving assembly of claim 1 comprising a plurality of tracks fixedly attached to the lower base, said tracks being adapted for guiding the rolling motions of the wheels or rollers.

11. A belt pumping unit moving assembly comprising:

(a) a lower base;

(b) a rack gear fixedly attached to the lower base;

(c) an upper base overlying the lower base, the belt pumping unit being fixedly attached to the upper base;

(d) a motor and pinion gear combination, said combination's motor being mounted upon the upper base, and said combination's pinion gear being engageable with the rack gear;

(e) a plurality of wheels or rollers mounted upon the upper base wherein, upon engagement of the pinion gear with the rack gear and upon actuation of the motor, the upper base and the belt pumping unit may rollably move along the lower base;

(f) a plurality of clevis brackets operatively interconnecting the wheels or rollers and the upper base, the clevis brackets being adapted for vertical movements between base support positions and disengaged positions, the clevis brackets and wheels moving upwardly with respect to the upper frame upon movements toward their disengaged positions; and (g) a plurality of removable plates adapted for, upon movements of the clevis brackets and wheels toward their base support positions, placements above the clevis brackets, such removable plate placements holding the clevis brackets and the wheels or rollers at their base support positions.

12. The belt pumping unit moving assembly of claim 11 wherein the removable plates have lateral end pull handles.

13. A belt pumping unit moving assembly comprising:

(a) a lower base;

(b) a rack gear fixedly attached to the lower base;

(c) an upper base overlying the lower base, the belt pumping unit being fixedly attached to the upper base;

(d) a motor and pinion gear combination, said combination's motor being mounted upon the upper base, and said combination's pinion gear being engageable with the rack gear;

(e) a plurality of wheels or rollers mounted upon the upper base wherein, upon engagement of the pinion gear with the rack gear and upon actuation of the motor, the upper base and the belt pumping unit rollably move along the lower base;

(f) a plurality of clevis brackets operatively interconnecting the wheels or rollers and the upper base, the clevis brackets being adapted for vertical movements between base support positions and disengaged positions, the clevis brackets and wheels or rollers moving upwardly with respect to the upper frame upon movements toward their disengaged positions; and (g) a plurality of vertical motion actuators operatively spanning between the upper base and the clevis brackets, said actuators being adapted for moving the clevis brackets and the wheels or rollers between the base support and disengaged positions, wherein the vertical motion actuators comprise springs adapted for biasing the clevis brackets and wheels or rollers toward the lower base.

* * * * *